US008245693B2

(12) United States Patent
Surnilla et al.

(10) Patent No.: US 8,245,693 B2
(45) Date of Patent: Aug. 21, 2012

(54) HIGH PRESSURE FUEL PUMP CONTROL FOR IDLE TICK REDUCTION

(75) Inventors: Gopichandra Surnilla, West Bloomfield, MI (US); Daniel Dusa, West Bloomfield, MI (US); Joseph Lyle Thomas, Kimball, MI (US); Joseph Norman Ulrey, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/336,911

(22) Filed: Dec. 23, 2011

(65) Prior Publication Data

US 2012/0090574 A1 Apr. 19, 2012

Related U.S. Application Data

(63) Continuation of application No. 12/330,233, filed on Dec. 8, 2008, now Pat. No. 8,091,530.

(51) Int. Cl.
*F02M 57/02* (2006.01)

(52) U.S. Cl. ..... 123/446; 123/458

(58) Field of Classification Search ..... 123/445, 123/446, 447, 506, 457–458
See application file for complete search history.

(56) References Cited

U.S. PATENT DOCUMENTS

| | | | |
|---|---|---|---|
| 4,643,155 | A | 2/1987 | O'Neill |
| 5,954,487 | A | 9/1999 | Straub et al. |
| 6,014,956 | A | 1/2000 | Cowden et al. |
| 6,061,224 | A | 5/2000 | Allen |
| 6,082,331 | A | 7/2000 | Barnes et al. |
| 6,192,864 | B1 | 2/2001 | Nishimura |
| 6,318,343 | B1 | 11/2001 | Nakagawa et al. |
| 6,336,445 | B1 | 1/2002 | Yamazaki et al. |
| 6,390,072 | B1 | 5/2002 | Breeden |
| 6,390,082 | B1 | 5/2002 | Duffy et al. |
| 6,497,223 | B1 | 12/2002 | Tuken et al. |
| 6,526,947 | B2 | 3/2003 | Shimada et al. |
| 6,640,788 | B2 | 11/2003 | Inoue et al. |
| 6,684,854 | B2 | 2/2004 | Coldren et al. |
| 6,763,808 | B2 | 7/2004 | Ryuzaki |
| 7,198,033 | B2 | 4/2007 | Inaguma et al. |
| 7,240,666 | B2 | 7/2007 | Okamoto |
| 7,328,690 | B2 | 2/2008 | Sheikh et al. |
| 7,360,526 | B2 * | 4/2008 | Kemmer ..... 123/490 |
| 7,467,619 | B2 | 12/2008 | Sheikh et al. |
| 7,552,720 | B2 | 6/2009 | Borg et al. |
| 7,559,313 | B2 | 7/2009 | Tokuo et al. |
| 7,819,637 | B2 | 10/2010 | Oda et al. |
| 2002/0040704 | A1 | 4/2002 | Onishi et al. |

(Continued)

FOREIGN PATENT DOCUMENTS

| | | | |
|---|---|---|---|
| DE | 10148218 | A1 | 4/2003 |

*Primary Examiner* — Thomas Moulis
(74) *Attorney, Agent, or Firm* — Julia Voutyras; Alleman Hall McCoy Russell & Tuttle LLP

(57) ABSTRACT

A method for controlling a mechanical solenoid valve of a high-pressure fuel pump to supply fuel to an engine is provided. In one example, current supplied to the mechanical solenoid valve is adjusted according to a pressure downstream of the fuel pump. The method can reduce current used to operate the mechanical solenoid valve as well as pump noise, at least during some conditions.

19 Claims, 5 Drawing Sheets

U.S. PATENT DOCUMENTS

2002/0043250 A1* 4/2002 Sugimoto et al. ..... 123/490
2002/0053338 A1 5/2002 Rembold et al.
2002/0129793 A1 9/2002 Tokuo et al.
2006/0201485 A1 9/2006 Usui et al.
2006/0243253 A1 11/2006 Knight
2009/0024299 A1 1/2009 Wilhelm et al.
2009/0241908 A1 10/2009 Tokuo et al.
2009/0281707 A1 11/2009 Katsura

* cited by examiner

HIGH PRESSURE FUEL PUMP CONTROL FOR IDLE TICK REDUCTION

CROSS REFERENCE TO RELATED APPLICATIONS

The present application is a continuation of U.S. patent application Ser. No. 12/330,233 filed Dec. 8, 2008, the entire contents of which are incorporated herein by reference for all purposes.

BACKGROUND AND SUMMARY

Many internal combustion engines utilize Gasoline Direct Injection (GDI) to increase the power efficiency and range over which the fuel can be delivered to the cylinder. GDI fuel injectors may require high pressure fuel for injection to create better atomization for more efficient combustion. In many GDI applications a high-pressure fuel pump may be used to increase the pressure of fuel delivered to the fuel injectors. The high-pressure fuel pump may include a mechanical solenoid valve (MSV) that may be actuated to control flow of fuel into the high-pressure fuel pump. Throughout operation of the high-pressure fuel pump, actuation of the MSV may generate noise vibration harshness (NVH) ticks. In particular, a first NVH tick may be generated as a result of an inlet valve of the MSV hitting its stop position upon opening of the MSV for fuel intake. A second NVH tick may be generated as a result of the inlet valve closing against a stop plate of the MSV upon closing of the MSV after fuel intake; and a third NVH tick may be generated by intake valve bounce as a result of release of the MSV being held closed while pressure builds during a delivery stroke of the high-pressure fuel pump. These NVH ticks may be perceived negatively by a vehicle operator, especially during engine idle when engine noise is reduced relative to engine noise at other engine speeds and operating conditions.

One approach to reduce the above described NVH ticks may include a method for controlling a mechanical solenoid valve of a high-pressure fuel pump to supply fuel to an engine. The method includes, during an idle condition, adjusting a pull-in current of the mechanical solenoid valve utilized to control closing of the mechanical solenoid valve based on a fuel pressure downstream of the high-pressure fuel pump, wherein the pull-in current is reduced when possible while enabling the mechanical solenoid valve to close as indicated by an increase in the downstream fuel pressure.

By calibrating the pull-in current of the mechanical solenoid valve in a feedback loop to the smallest nominal value that is still large enough to close the mechanical solenoid valve, the closing force of the mechanical solenoid valve may be reduced so that the valve closes gently against the stop plate. In this way, the NVH tick generated as a result of MSV closing may be reduced or eliminated to improve drivability of the vehicle.

Another approach to reduce the above described NVH ticks may include a method for controlling a mechanical solenoid valve of a high-pressure fuel pump to supply fuel to an engine. The method includes, during an idle condition, adjusting a pull-in current of the mechanical solenoid valve utilized to control closing of the mechanical solenoid valve based on a fuel pressure downstream of the high-pressure fuel pump, wherein the pull-in current is reduced when possible while enabling the mechanical solenoid valve to close as indicated by an increase in the downstream fuel pressure. The method further includes, in response to the increase in the downstream fuel pressure, initiating a holding current duty cycle utilized to hold the mechanical solenoid valve in a closed position, the duty cycling having a duration ending at substantially top dead center of a delivery pump stroke of the high-pressure solenoid valve.

By extending the MSV holding current duty cycle to top dead center of the pump stroke, the NVH tick generated by valve bounce upon release of holding the MSV closed may be substantially merged or at least partially aligned with the NVH tick generated by the inlet valve of the MSV hitting its stop position upon MSV opening for fuel intake. In other words, the two NVH ticks may be merged or aligned to appear as a singe NVH tick as perceived by a vehicle operator. In this way, the overall NVH quality associated with idle ticks may be reduced resulting in improved drivability of the vehicle.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION

DETAILED DESCRIPTION

Figure 1:
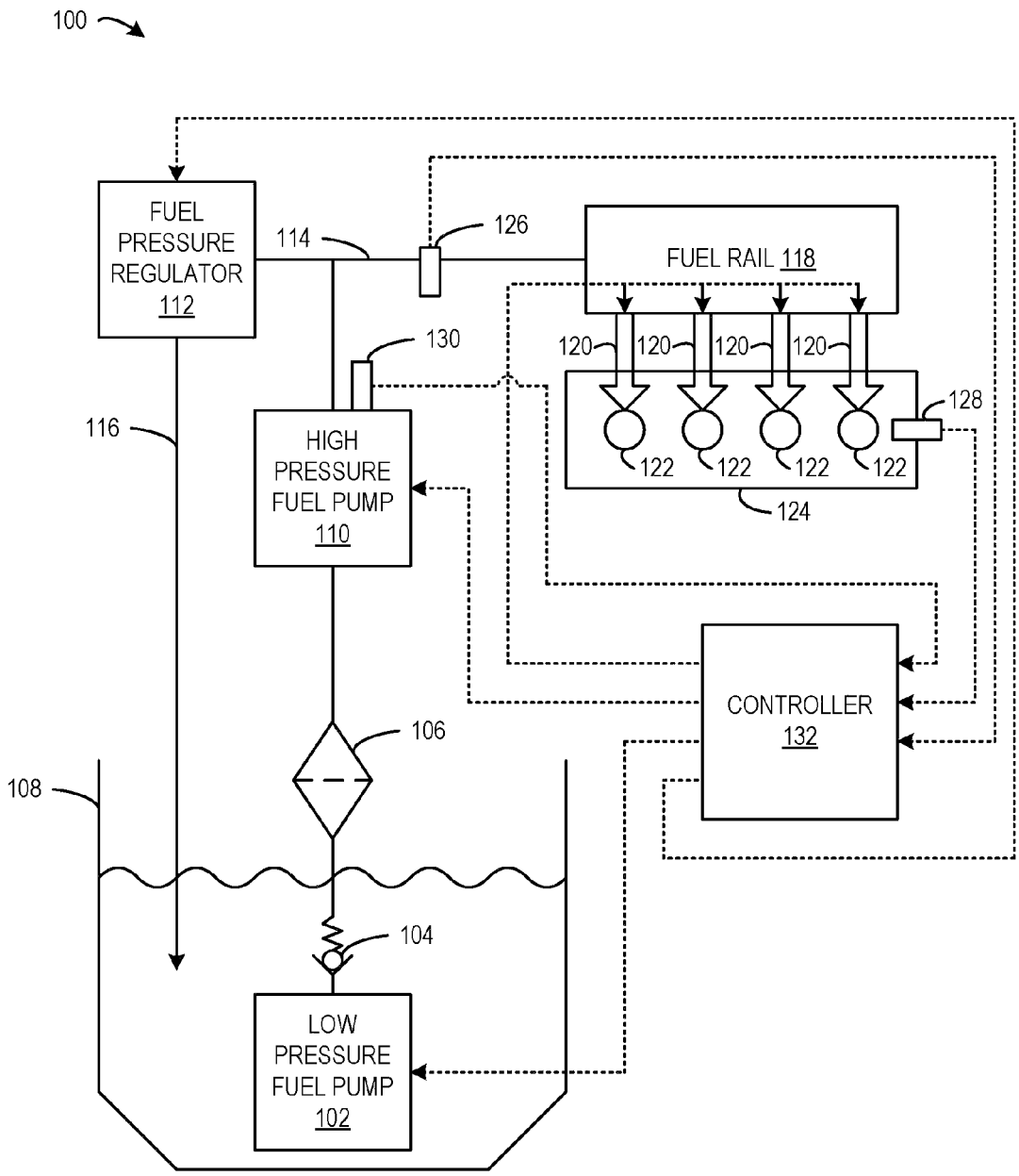
FIG. 1 shows a schematic diagram of an example fuel delivery system.

FIG. 1 shows a schematic depiction of a fuel delivery system 100 for an internal combustion engine that utilizes gasoline direct injection (GDI) for use in a vehicle. Fuel delivery system 100 includes a low-pressure fuel pump 102 to pump liquid fuel from fuel tank 108. In this embodiment, fuel pump 102 is an electronically controlled variable speed lift pump. In some cases, low-pressure fuel pump 102 may only operate at a limited number of speeds. It will be appreciated that the fuel tank may contain any fuel suitable for an internal combustion engine such as gasoline, methanol, ethanol, or any combination thereof.

Low-pressure fuel pump 102 is fluidly coupled to check valve 104 to facilitate fuel delivery and maintain fuel line pressure. In particular, check valve 104 includes a ball and spring mechanism that seats and seals at a specified pressure differential to deliver fuel downstream. In some embodiments, fuel delivery system 100 may include a series of check valves fluidly coupled to low-pressure fuel pump 102 to further impede fuel from leaking back upstream of the valves. Check valve 104 is fluidly coupled to filter 106. Filter 106 may remove small impurities that may be contained in the fuel that could potentially damage vital engine components. Fuel may be delivered from filter 106 high-pressure fuel pump 110. High-pressure fuel pump 110 may increase the pressure of fuel received from the fuel filter from a first pressure level generated by low-pressure fuel pump 102 to a second pressure level higher than the first level. High-pressure fuel pump 110 may deliver high pressure fuel to fuel rail 118 via fuel line 114. High pressure fuel pump 110 will be discussed in further detail below with reference to FIG. 2. Operation of high-pressure fuel pump 102 may be adjusted based on operating conditions of the vehicle in order to reduce noise, vibration, and harshness (NVH) which may be perceived positively by a vehicle operator. Methods for adjusting operation of higher-pressure fuel pump 110 to reduce NVH will be discussed in further detail below with reference to FIGS. 3-5.

Fuel pressure regulator 112 may be coupled in line with fuel line 114 to regulate fuel delivered to fuel rail 118 at a set-point pressure. To regulate the fuel pressure at the set-point, fuel pressure regulator 112 may return excess fuel to fuel tank 108 via return line 116. It will be appreciated that operation of fuel pressure regulator 112 may be adjusted to change the fuel pressure set-point to accommodate operating conditions.

Fuel rail 118 may distribute fuel to each of a plurality of fuel injectors 120. Each of the plurality of fuel injectors 120 may be positioned in a corresponding cylinder 122 of engine 124 such that during operation of fuel injectors 120 fuel is injected directly into each corresponding cylinder 122. Alternatively (or in addition), engine 124 may include fuel injectors positioned at the intake port of each cylinder such that during operation of the fuel injectors fuel is injected in to the intake port of each cylinder. In, the illustrated embodiment, engine 124 includes four cylinders. However, it will be appreciated that the engine may include a different number of cylinders.

Controller 132 may receive various signals from sensors coupled to fuel delivery system 100 and engine 124. For example, controller 132 may receive a fuel pressure (and/or temperature) signal from fuel sensor 126 which may be positioned downstream of high-pressure fuel pump 110 (e.g. positioned in fuel line 114). In some cases, fuel pressure measured by fuel sensor 126 may be indicative of fuel rail pressure. In some embodiments, a fuel sensor may be positioned upstream from high-pressure fuel pump 110 to measure a pressure of fuel exiting low-pressure fuel pump 102. Further, controller 132 may receive engine/exhaust parameter signals from engine sensor(s) 128. For example, these signals may include measurement of inducted mass air flow, engine coolant temperature, engine speed, throttle position, and absolute manifold pressure, emission control device temperature, etc. Note that various combinations of the above measurements as well as measurements of other related parameters may be sensed by sensor(s) 128. Further, controller 132 may receive signals from noise sensor 130 indicative of a NVH level generated by operation of high-pressure fuel pump 110. In some embodiments, NVH levels may be derived from engine operating parameters and/or signals of other sensors. It will be appreciated that the controller may receive other signals indicative of vehicle operation.

Controller 132 may provide feedback control based on signals received from fuel sensor 126, engine sensor(s) 128, and/or noise sensor 130, among others. For example, controller 132 may send signals to adjust a current level or pulse width of a mechanical solenoid valve (MSV) of high-pressure fuel pump 110 to adjust operation of high-pressure fuel pump 110, a fuel pressure set-point of fuel pressure regulator 110, and/or a fuel injection amount and/or timing based on signals from fuel sensor 126, engine sensor(s) 128, and/or noise sensor 130.

In one example controller 132 is a microcomputer that includes a microprocessor unit, input/output ports, an electronic storage medium for executable programs and calibration values such as read only memory, random access memory, keep alive memory, and a data bus. The storage medium read-only memory can be programmed with computer readable data representing instructions executable by the processor for performing the method described below as well as other variants that are anticipated but not specifically listed.

Figure 2:
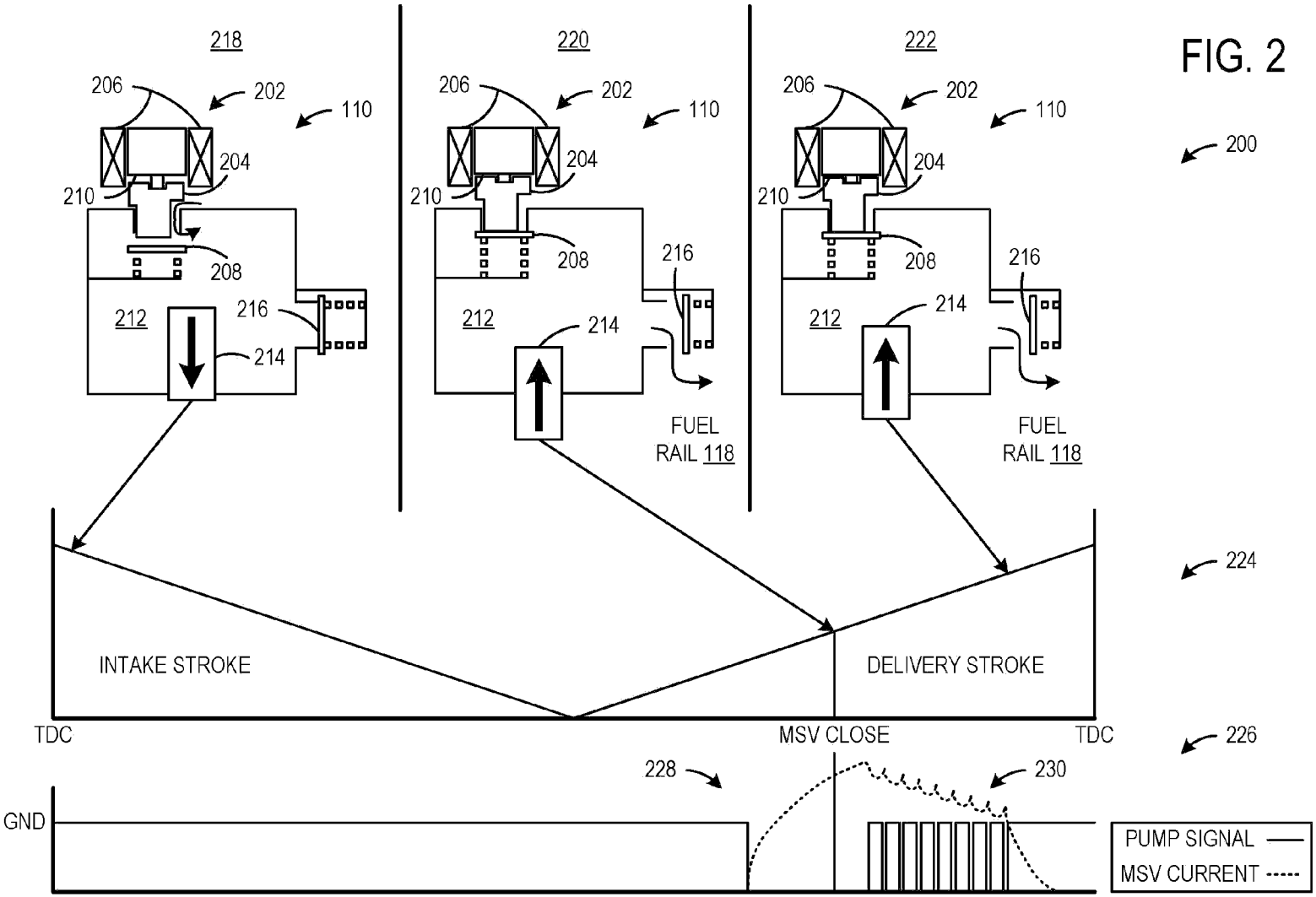
FIG. 2 shows an intake and delivery sequence of a high pressure fuel pump of the fuel delivery system of FIG. 1.

FIG. 2 shows an example operating sequence 200 of high-pressure fuel pump 110. In particular, sequence 200 shows the operation of high-pressure fuel pump 110 during intake and delivery strokes of fuel supplied to fuel rail 118. Each of the illustrated moments (i.e., 218, 220, 222) of sequence 200 show events or changes in the operating state of high-pressure fuel pump 110 that generate NVH ticks that may be perceived by a vehicle operator at idle. Pump-position timing chart 224 shows the points at which the illustrated moments of sequence 200 occur during the intake and delivery strokes of high-pressure pump 110. Signal timing chart 226 shows a pump control signal (solid line) and a current signal (dashed line) of a mechanical solenoid valve (MSV) 202 that controls fuel intake into high-pressure fuel pump 110. In particular, at 228 a pull-in current of the pump signal may be initiated (i.e., energized to a high state) which increases the MSV current to close the MSV. At 230, a holding current duty cycle of the pump signal may be initiated based upon closing of the MSV which is indicated, in one example, by a rise in downstream fuel pressure. The holding current duty cycle maintains some MSV current to maintain the MSV in a closed position.

MSV 202 includes solenoids 206 that may be electrically energized by controller 132 to draw inlet valve 204 away from the solenoids in the direction of stop plate 208 to close MSV 202. In particular, controller 132 may send a pump signal that may be modulated to adjust the operating state (e.g., open or closed) of MSV 202. Modulation of the pump signal may include adjusting a current level, a pulse-width, a duty cycle, or another modulation parameter. Further, inlet valve 204 may be biased such that, upon solenoids 206 becoming de-energized, inlet valve 204 may move in the direction of the solenoids until contacting inlet valve plate 210 to be placed in an open state in which fuel may flow into pressure chamber 212 of high-pressure fuel pump 110. Operation of pump 214 may increase the pressure of fuel in pressure chamber 212. Upon reaching a pressure set-point, fuel may flow through outlet valve 216 to fuel rail 118.

At 218, a first NVH tick generating event may occur shortly after top dead center (TDC) of the stroke of pump 214 when high-pressure fuel pump 110 is transitioning from delivery to intake. In particular, the tick may be generated as a result of MSV 202 opening such that inlet valve 204 extends and hits a fully open stop position. In the illustration, at 218 the holding current of the pump signal is turned off and the fuel pressure within the pressure chamber is maintaining the MSV in a closed position. Further, opening of MSV 202 may be caused by a fuel pressure drop in high-pressure fuel pump 110 upon fuel exiting pressure chamber 212 and closing of outlet valve 216.

At 220, a second NVH tick generating event may occur during the delivery stroke of pump 214 upon closing of MSV 202. In particular, the tick may be generated as a result of inlet valve 204 moving away from solenoids 206 and contacting inlet valve plate 210 to close MSV 202. The closing force of inlet valve 204 may correspond to the current level of MSV 202 built up by the pump signal being placed in a high state. As shown by signal timing chart 226, at the time at which the MSV is closed, the MSV current has been built up by the pump signal to overcome the pressure differential and close the inlet valve. Subsequent to closing of the inlet valve, the pump signal may command a holding current duty cycle to lower the MSV current and maintain the inlet valve closed.

At 222, a third NVH tick generating event may occur during the delivery stroke of pump 214 when the pressure differential upstream of MSV 202 becomes great enough to maintain MSV 202 in a closed state and the pump signal is commanded to end the holding current duty cycle such that the pump signal goes to ground and lowers the holding current. Upon ending the holding current duty cycle and lowering the MSV holding current, inlet valve 204 of MSV 202 may bounce against stop plate 208 until the upstream fuel pressure stabilizes inlet valve 204 against stop plate 208. This bouncing of the intake valve is what generates the third NVH tick.

Figure 3:
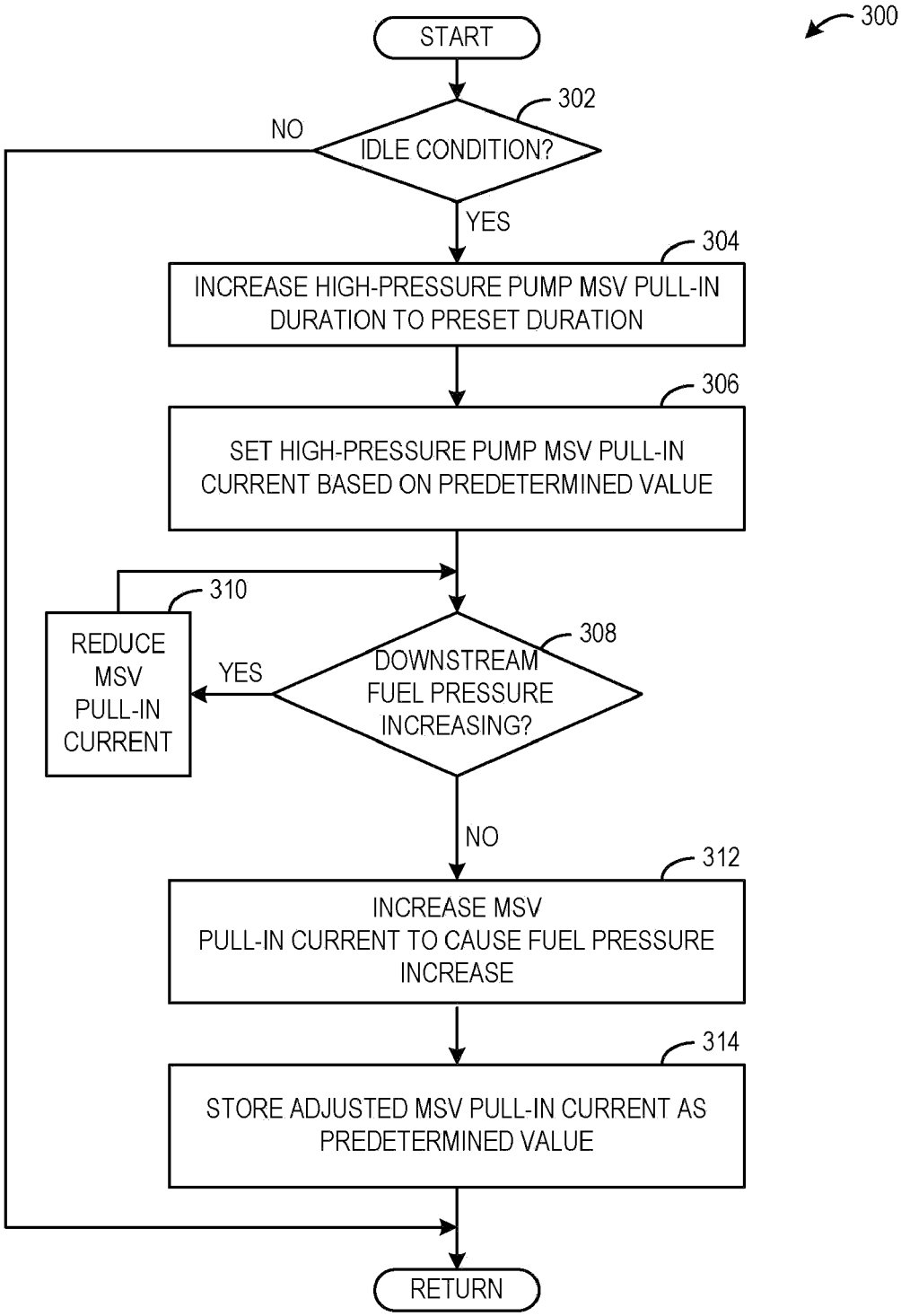
FIG. 3 shows a flow diagram of an example method for operating the high pressure fuel pump to reduce operational noise ticks at idle.
Figure 4:
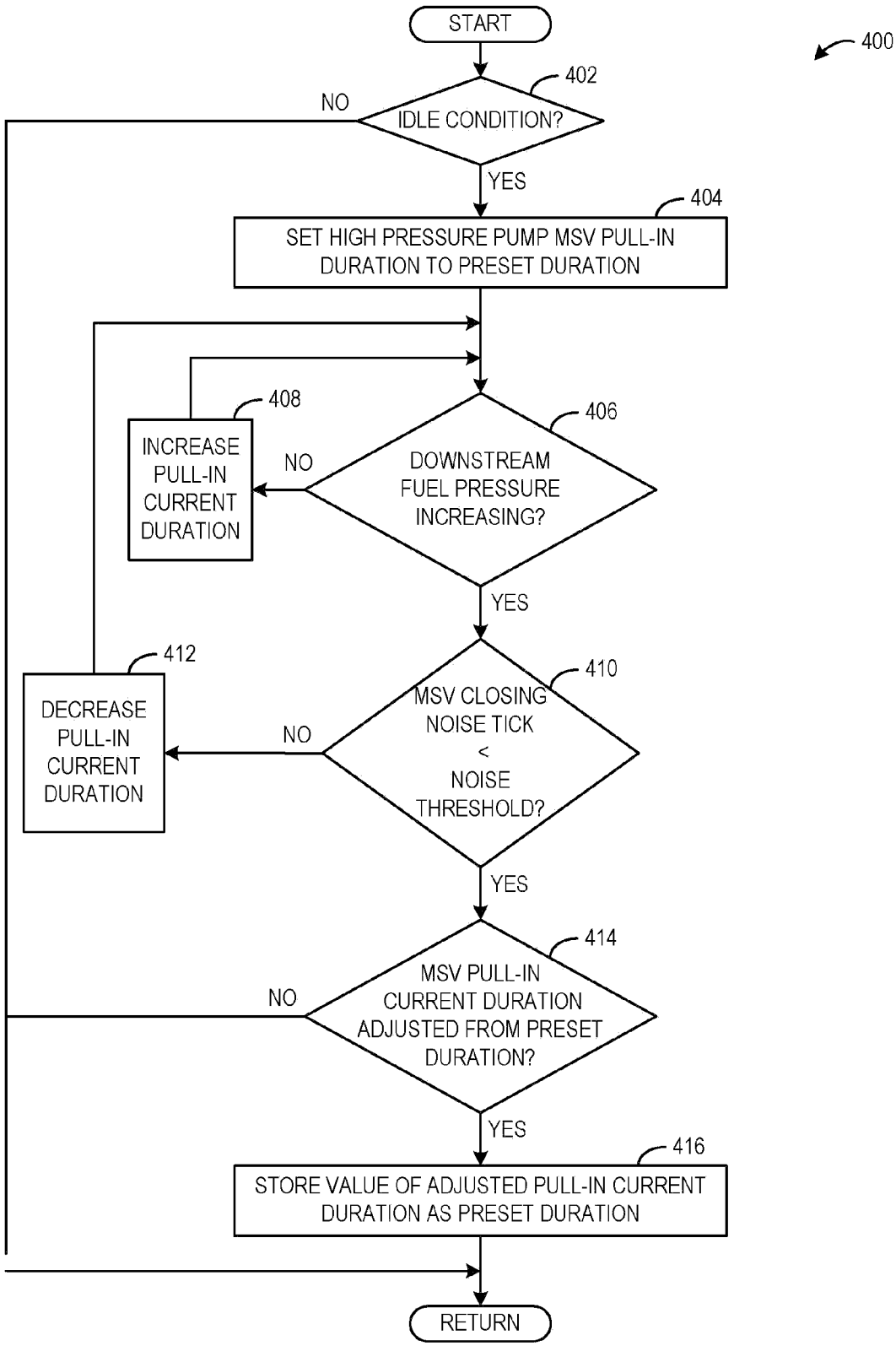
FIG. 4 shows a flow diagram of another example method for operating the high pressure fuel pump to reduce operational noise ticks at idle.
Figure 5:
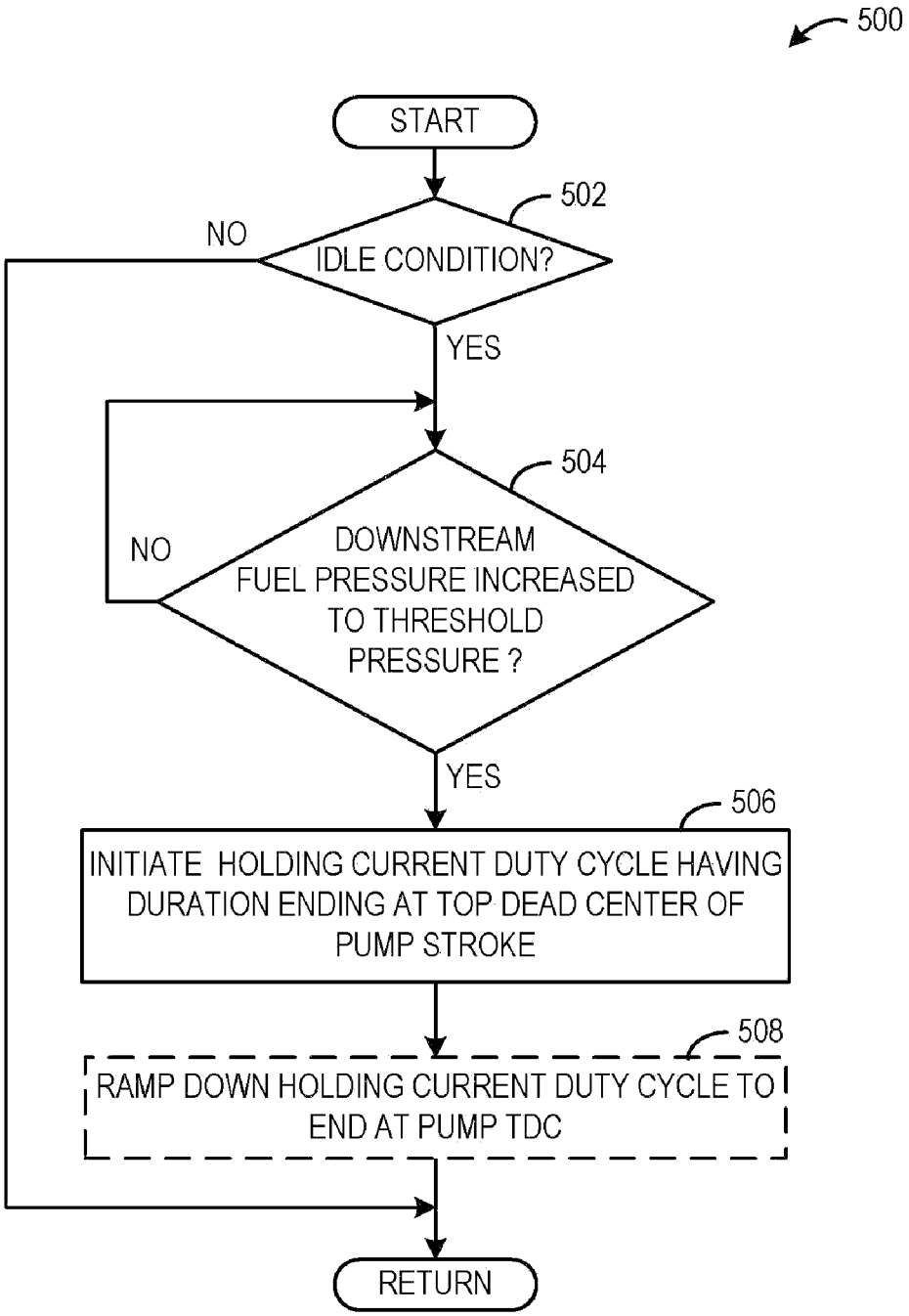
FIG. 5 shows a flow diagram of yet another example method for operating the high pressure fuel pump to reduce operational noise ticks at idle.

FIGS. 3-5 show flow diagrams of example methods for controlling operation of the high-pressure fuel pump to reduce NVH by eliminating or merging the above described NVH ticks. Referring to FIG. 3, method 300 reduces or eliminates NVH ticks generated as a result of the MSV closing by reducing a rate of MSV pull-in current increase. The method begins at 302, where the method may include determining if the vehicle is idling or in an idle condition. Typically, at idle, vehicle noise may be relatively low since engine output is low and engine/vehicle speed is low. Thus, NVH ticks may be more easily perceived by a vehicle operator and should be reduced or eliminated. During other operating conditions, engine noise and wind noise may cover up any NVH ticks so as to go unnoticed by a vehicle operator. In one example, an idol condition is determined based on an engine speed signal measured or derived from engine sensor(s) 128. If the vehicle is idling the method moves to 304. Otherwise, the vehicle is not idling and the method ends or returns to other control operations.

At 304, the method may include increasing the high-pressure pump MSV pull-in current duration to a preset duration. At idle, the time available for fuel intake into the high-pressure fuel device is higher than at other conditions since engine demand is low and thus fuel demand is reduced. As such, the preset duration may be longer than during operations at speeds higher than idle. This condition may be used to advantage by extending the pull-in current duration in combination with reducing the pull-in current to lower the rate of MSV pull-in current increase.

At 306, the method may include setting a high-pressure pump MSV pull-in current based on a predetermined value. The predetermined value may be a nominal value or a value learned from previous iterations of method 300.

At 308, the method may include determining if a pressure downstream of the high-pressure fuel pump is increasing or has increased to a threshold pressure. In other words, it may be determined if the MSV is closed based on the currently set pull-in current. In one example, the determination may be made based on the pressure signal of fuel sensor 126, such as a fuel rail pressure (FPR) error signal. If the pressure is greater than or equal to the threshold pressure then the MSV is closed. If the downstream fuel pressure is less than the threshold then the MSV is open and the pull-in current should be increased. If the MSV is closed the method moves to 310. Otherwise, the MSV is open and the method moves to 312.

At 310, the method may include reducing the MSV pull-in current. In some embodiments, the adjustment of the pull-in current can be achieved by directly decreasing the pull-in current peak level (i.e., the high current level). In some embodiments, the pull-in current adjustment can be achieved by decreasing a pull-in current duty cycle pulse-width (i.e., the low current level). In some embodiments, the pull-in current peak level and the pull-in current duty cycle pulse-width may be adjusted to decrease the pull-in current. These adjustments may be by a preset value, or the may by a variable value based on operating parameters of the engine and the fuel delivery system. Upon adjustment of the pull-in current, the method may return to 308 where the MSV may be checked to see if it is closed. If the MSV is still closed, the method loops to reduce the pull-in current till the MSV opens.

At 312, the method may include increasing the MSV pull-in current to a level prior to opening of the MSV that causes the MSV to close. In some cases, the pull-in current may be increased to the most previous iteration of the value prior to opening of the MSV. This may calibrate the pull-in current to the smallest level while still enabling the MSV to close. Again, the increase of the parameter value may be performed by adjusting the pull-in current peak level and/or the pull-in current duty cycle pulse-width. Further, the adjustment may be preset or variable based on operation conditions.

At 314, the method may include storing the adjusted MSV pull-in current as the predetermined value. The updated predetermined value may be used during the next idle condition to operate the MSV at substantially the lowest nominal pull-in current where the MSV remains closed.

The above described method may be used to automatically calibrate the MSV pull-in current to a very small nominal value in a closed loop manner. By calibrating the pull-in current to the lowest value to close the MSV in a closed loop manner, the MSV may continue operation and the rate of MSV current increase may be reduced which in turn may reduce the velocity of the intake valve (or needle) of the MSV as it comes to rest on the intake valve plate (or seat) thus reducing bounce that creates noise. In this way, NVH ticks may be reduced and vehicle operation as perceived by a vehicle operator may be improved.

Referring to FIG. 4, method 400 reduces or eliminates NVH ticks generated as a result of the MSV closing by reducing the current level of the MSV at closing of the MSV. The method begins at 402, where the method may include determining if the vehicle is idling or in an idle condition. Typically, at idle, vehicle noise may be relatively low since engine output is low and vehicle speed is low. Thus, NVH ticks may be more easily perceived by a vehicle operator and should be reduced or eliminated. During other operating conditions, engine noise and wind noise may cover up any NVH ticks so as to go unnoticed by a vehicle operator. In one example, an idol condition is determined based on an engine speed signal measured or derived from engine sensor(s) 128. If the vehicle is idling the method moves to 404. Otherwise, the vehicle is not idling and the method ends or returns to other control operations.

At 404, the method may include setting the high-pressure pump MSV pull-in current duration to a preset duration. The preset duration may be a factory set duration, a duration determined from feedback through previous iterations of the method, or a duration determined in another suitable way.

At 406, the method may include determining if a fuel pressure downstream of the high-pressure pump is increasing or has increased to a threshold fuel pressure. This may indicate that the duration is long enough to facilitate closing of the MSV. In one example, the fuel rail pressure is received from fuel sensor 126 of FIG. 1. If it is determined that the fuel rail pressure is increasing the method moves to 410. Otherwise, the fuel pressure is not increasing and the method moves to 408.

At 408, the method may include increasing the pull-in current duration to provide additional time for the pull-in current to increase to facilitate MSV closing. The pull-in current duration may be increased by a predetermined amount or may be increased by a variable amount based on operating conditions. Upon increasing the pull-in current duration, the method loops back to 406 where the downstream fuel pressure may be checked to see if the MSV is closed. If the MSV is still open, the method loops to increase the pull-in current duration until the downstream fuel pressure increases indicating that the MSV is closed.

At 410, the method may include determining if a noise tick generated by MSV closing is below an idle noise threshold. The noise threshold may be a default threshold, a variable threshold based on operating conditions, or a threshold determined by another suitable way. In one example, the threshold is set to a noise level that is imperceptible to a vehicle operator at idle. In one example, the noise tick is received from noise sensor 130. In another example, the noise tick is derived from other measured engine parameters. If the noise tick is below the noise threshold the method moves to 414. Otherwise, the noise tick is equal to or greater than the noise threshold and the method moves to 412.

At 412, the method may include decreasing the pull-in current duration. Since the fuel rail pressure is at the set-point fuel pressure, the predetermined pull-in current duration is long enough to enable MSV closing. However, the predetermined pull-in current duration is also long enough for the MSV to build current to a level that causes a noise tick perceivable by a vehicle operator at idle. Thus, the pull-in current duration may be decreased. The pull-in current duration may be decreased by a predetermined amount or may be decreased by a variable amount based on operating conditions. By decreasing the pull-in current duration, there is less time for the velocity of the inlet valve to increase. As such, the inlet valve may contact the inlet valve plate with less velocity which may result in a reduction in noise. Upon decreasing the pull-in current duration, the method may loop back to 406 to check that the decreased pull-in current duration is long enough to facilitate MSV closing and sufficient fuel pressure increase in the fuel rail. Through this feedback loop, the pull-in current duration may be adapted to reduce the noise intensity of NVH ticks while maintaining closing of the MSV.

At 414, the method may include determining if the MSV pull-in current duration has been adjusted from the preset duration. The pull-in current duration may be adjusted to adapt the pull-in current duration to the duration where the MSV still closes and the noise generated from the MSV closing is below the noise threshold. If the pull-in current duration has been adjusted the method moves to 416. Otherwise, the preset pull-in current duration of the MSV meets the noise tick and closing criteria and the method ends or returns to other control operations.

At 416, the method may include storing the value of the adjusted pull-in current duration as the preset duration. The updated or calibrated duration may be used to control closing of the MSV at the next MSV closing event.

The above described method may be used to automatically calibrate the MSV pull-in current duration to a very small nominal value in a closed loop manner. By calibrating the pull-in current duration while maintaining the set-point fuel pressure in the fuel rail by keeping the MSV closed, the MSV may continue operation and the MSV current may be prevented from increasing or the peak current may be reduced which in turn reduces the velocity of the intake valve (or needle) as it comes to rest on the intake valve plate (or seat) which reduces bounce. In this way, NVH ticks may be reduced and vehicle operation as perceived by a vehicle operator may be improved.

It will be appreciated that the noise threshold utilized in the above described method may also be applied to method 300. As such, the pull-in current may be adjusted based on the downstream fuel pressure and the noise level of the high-pressure fuel pump. Accordingly, the pull-in current may be reduced so that the noise level is less than a threshold noise level and the downstream fuel pressure is greater than or equal to a threshold pressure indicative of closing of the mechanical solenoid valve. Further, the pull-in current need not be reduced based on the downstream fuel pressure being greater than or equal to the fuel pressure threshold and the noise signal being less than the noise threshold. Further still, the pull-in current may be increased based on the downstream fuel pressure being less than the fuel pressure threshold.

Referring to FIG. 5, method 500 shifts NVH ticks generated by the above described third NVH tick generating event to overlap with the first NVH tick generating event to reduce the overall number of NVH ticks perceived by a vehicle operator. The method begins at 502, where the method may include determining if the vehicle is idling or in an idle condition. Typically, at idle, vehicle noise may be relatively low since engine output is low and vehicle speed is low. Thus, NVH ticks may be more easily perceived by a vehicle operator and should be reduced or eliminated. During other operating conditions, engine noise and wind noise may cover up any NVH ticks so as to go unnoticed by a vehicle operator. In one example, an idol condition is determined based on an engine speed signal measured or derived from engine sensor(s) 128. If the vehicle is idling the method moves to 504. Otherwise, the vehicle is not idling and the method ends or returns to other control operations.

At 504, the method may include determining if a fuel pressure downstream of the high-pressure pump has increased to approximately a threshold pressure. This may indicate that the MSV has closed. If the downstream fuel pressure has increased to the threshold pressure the method moves to 506. Otherwise the downstream fuel pressure has not reached the set-point fuel level and the method loop pack to 504 and polls for closing the downstream pressure to be equal to or greater than the threshold.

At 506, the method may include adjusting the high-pressure pump MSV holding current duty cycle duration to TDC of the pump. By extending the holding current duty cycle to TDC, any noise ticks generated by the holding current being turned off resulting in release of the MSV may substantially merge with noise ticks generated as a result of opening of the MSV for fuel intake.

In some embodiments, at 508, the method may include ramping down the peak level of the holding current duty cycle prior to TDC of the pump stroke. The slope of the ramp may cause the duty cycle to end at TDC. By ramping down the holding current duty cycle, the MSV current may be reduced gradually before reaching TDC which, in turn, may reduce the velocity of the intake valve so that it contacts the intake valve plate with less force. This may reduce or eliminate the NVH tick that would be generated upon release of holding the MSV closed, as opposed to merging the noise tick with a noise tick generated by opening of the MSV. In this way, the overall NVH quality associated with idle tick may be improved so that idle ticks are perceived less by a vehicle operator.

It will be appreciated that two or more of the above described methods may be combined to control the high-pressure fuel pump to reduce NVH ticks and improve the quality of vehicle operation.

Note that the example control and estimation routines included herein can be used with various system configurations. The specific routines described herein may represent one or more of any number of processing strategies such as event-driven, interrupt-driven, multi-tasking, multi-threading, and the like. As such, various actions, operations, or functions illustrated may be performed in the sequence illustrated, in parallel, or in some cases omitted Likewise, the order of processing is not necessarily required to achieve the features and advantages of the example embodiments described herein, but is provided for ease of illustration and description. One or more of the illustrated actions, functions, or operations may be repeatedly performed depending on the particular strategy being used. Further, the described operations, functions, and/or acts may graphically represent code to be programmed into computer readable storage medium in the control system It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein. For example, a fuel system may include multiple fuel pumps, an electronically-controlled fuel pressure regulator having a variable fuel pressure set-point coupled downstream of at least one of the fuel pumps, and a pressure delay device coupled downstream of the fuel pressure regulator.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

controlling a mechanical solenoid valve (MSV) of a high-pressure fuel pump supplying fuel to an engine via direct injection, including, during an idle condition, adjusting a pull-in current of the MSV that controls closing of the MSV based on a fuel pressure downstream of the high-pressure fuel pump, said adjusting including reducing the pull-in current while enabling the MSV to close as indicated by an increase in the downstream fuel pressure.

2. The method of claim 1, wherein during a condition where fuel pressure downstream of the high-pressure fuel pump does not increase upon initiation of the pull-in current, increasing the pull-in current to a level that enables the MSV to close so that the fuel pressure increases.

3. The method of claim 2, further comprising:

increasing a pull-in current duration to a duration that is longer than a pull-in current duration at engine speeds above an idle engine speed that allows for a reduced pull-in current level.

4. The method of claim 3, wherein adjusting the pull-in current includes reducing a peak level of the pull-in current to reduce the pull-in current.

5. The method of claim 3, wherein adjusting the pull-in current includes reducing a duty cycle pulse width of the pull-in current to reduce the pull-in current.

6. The method of claim 2, wherein adjusting the pull-in current includes reducing a duration of the pull-in current to reduce the pull-in current.

7. The method of claim 2, further comprising:

initiating a holding current duty cycle in response to the fuel pressure arriving at a fuel pressure set-point indicating that the MSV is closed.

8. The method of claim 7, wherein a duration of the holding current duty cycle ends at top dead center of a delivery pump stroke of the high-pressure fuel pump.

9. The method of claim 8, further comprising:

ramping down a peak current level of the holding current duty cycle prior to top dead center of the pump stroke.

10. The method of claim 1, wherein an indication of the fuel pressure is provided by a fuel pressure sensor positioned proximate to a fuel rail of the engine.

11. An engine system, comprising:

a low-pressure fuel pump;

a high-pressure fuel pump including a mechanical solenoid valve (MSV) to control fuel flow into the high-pressure fuel pump, the low-pressure fuel pump coupled upstream of the high-pressure fuel pump;

a fuel pressure sensor to sense a fuel pressure downstream of the high-pressure fuel pump; and a controller configured to, at an idle condition, adjust a pull-in current utilized to control closing of the MSV based on the fuel pressure received from the fuel pressure sensor, wherein the pull-in current is reduced while enabling the MSV to close as indicated by an increase in the fuel pressure.

12. The system of claim 11, further comprising:

a noise sensor to sense an operating noise level of the MSV, the noise sensor providing the noise level to the controller; and wherein the controller is further configured to adjust the pull-in current based on the downstream fuel pressure and the noise level.

13. The system of claim 12, wherein the controller is further configured to reduce the pull-in current so that the noise level is less than a threshold noise level and the fuel pressure is greater than or equal to a threshold pressure level indicative of closing of the MSV.

14. The system of claim 13, wherein the controller is further configured to not reduce the pull-in current based on the fuel pressure level being greater than or equal to the fuel pressure threshold and the noise level being less than the noise threshold.

15. The system of claim 14, wherein the controller is further configured to increase the pull-in current based on the fuel pressure level being less than the fuel pressure threshold.

16. The system of claim 11, wherein adjusting the pull-in current includes reducing a peak level of the pull-in current to reduce the pull-in current.

17. The system of claim 11, wherein adjusting the pull-in current includes reducing a duty cycle pulse width of the pull-in current to reduce the pull-in current.

18. The system of claim 11, wherein adjusting the pull-in current includes reducing a duration of the pull-in current to reduce the pull-in current.

19. A method, comprising:

controlling a mechanical solenoid valve (MSV) of a high-pressure fuel pump coupled downstream of a low-pressure fuel pump, the high-pressure fuel pump supplying fuel to a direct injection system of an engine, the controlling including:

during an idle condition, adjusting a pull-in current of the MSV utilized to control closing of the MSV based on a fuel pressure downstream of the high-pressure fuel pump, wherein the pull-in current is reduced while enabling the MSV to close as indicated by an increase in the downstream fuel pressure;

in response to the increase in the downstream fuel pressure, initiating a holding current duty cycle utilized to hold the MSV in a closed position, the duty cycle having a duration ending at substantially top dead center of a delivery pump stroke of the high-pressure solenoid valve; and ramping down a peak current level of the holding current duty cycle prior to top dead center of the pump stroke such that the ramp ends at substantially top dead center of the pump stroke.

* * * * *